US005829866A

United States Patent [19]

Stegeman

[11] Patent Number: 5,829,866

[45] Date of Patent: Nov. 3, 1998

[54] STREET LIGHT LUMINAIRE

[75] Inventor: Jacob Stegeman, Meyzieu, France

[73] Assignee: U.S. Philips Corporation, New York, N.Y.

[21] Appl. No.: 805,253

[22] Filed: Feb. 24, 1997

[30] Foreign Application Priority Data

Feb. 26, 1996 [EP] European Pat. Off. ..... 96200476

[51] Int. Cl.[6] ..... H01R 33/00; F21V 21/00; F21V 17/00; F21S 1/10

[52] U.S. Cl. ..... 362/226; 362/263; 362/374; 362/375; 362/431

[58] Field of Search ..... 362/226, 263, 362/363, 374, 375, 382, 431

[56] References Cited

U.S. PATENT DOCUMENTS

| | | | |
|---|---|---|---|
| 2,388,029 | 10/1945 | Bates | 362/61 |
| 3,530,287 | 9/1970 | Husby | 362/226 |
| 3,551,667 | 12/1970 | Husby et al. | 362/226 |
| 3,755,665 | 8/1973 | Grindle | 362/310 |
| 4,028,541 | 6/1977 | Franklin | 362/307 |
| 4,479,173 | 10/1984 | Rumpakis | 362/294 |
| 4,538,217 | 8/1985 | Ewing et al. | 362/375 |
| 5,457,618 | 10/1995 | Kim | 362/382 |
| 5,584,575 | 12/1996 | Fickel | 362/364 |

FOREIGN PATENT DOCUMENTS

| | | | |
|---|---|---|---|
| 111651 | 8/1964 | Czechoslovakia | 362/374 |
| 0686805A1 | 12/1995 | European Pat. Off. | F21V 19/04 |
| 39 38 792 A1 | 5/1991 | Germany | 362/382 |
| 11629 | 12/1917 | United Kingdom | 362/375 |
| WO9605467 | 2/1996 | WIPO | F21V 19/04 |

*Primary Examiner*—Ira C. Lazarus
*Assistant Examiner*—Ljiljana V. Ciric
*Attorney, Agent, or Firm*—F. Brice Faller

[57] ABSTRACT

A housing includes a hood having an opening which is closed by a lid having a lampholder fixed thereto so that the lampholder extends through an opening in a reflector fixed in the housing, and a lamp held by the lampholder is positioned in the reflector. Electrical connection is provided by a plug mounted to the lid and a socket mounted to the housing. The lid is releasable by means of arms which pivot in response to pulling a knob on the lid, whereby the lid and lampholder can be removed with one hand. The hood is hinged so that it can pivot only when the lid is removed.

6 Claims, 2 Drawing Sheets

STREET LIGHT LUMINAIRE

BACKGROUND OF THE INVENTION

The invention relates to a sheet lighting luminaire of the type comprising a lamp enclosed by a reflector and a transparent plate, wherein the lamp can be replaced without removing the plate.

Such a street lighting luminaire is known from EP-A-0 686 805.

The known street lighting luminaire renders it possible to replace an electric lamp in the luminaire with a new lamp by opening a hinged cover of the housing and removing the lampholder with the lamp from the lampholder opening of the reflector without removing the transparent plate.

During its removal the lampholder must be rotated before it can be taken from the reflector in a translatory movement. The electrical connection between the lampholder and the supply unit is broken with certainty upon the removal of the lampholder, so that the lamp can be safely exchanged. This is an advantage of the known luminaire.

It is a disadvantage of the luminaire, however, that the hinged cover must first be opened and be fixed in the open position before the lampholder can be brought to the exterior. The old lamp can then be removed from the lampholder and a new lamp can be inserted. After the lampholder with the lamp has been mounted in the luminaire again, the cover can be closed.

This procedure of exchanging lamps in street lighting luminaires, which is to be carried out usually from a cherry picker on account of the height of the masts used, is comparatively time-consuming.

A street lighting luminaire is known from US-A-4,028,541 whose transparent plate with the reflector and lampholder with lamp connected thereto can hinge outwards, whereupon the lampholder can be detached for exchanging the lamp.

SUMMARY OF THE INVENTION

According to the invention, the housing has an opening through which the lampholder can be brought into its operational position in the lampholder opening, which opening in the housing is closed by means of a lid which is detachable from the housing and to which the lampholder is fastened.

The street lighting luminaire according to the invention renders it possible to exchange an inserted lamp easily and quickly in that the detachable lid is taken from the housing, and thus bringing the lampholder and the lamp held therein to the outside simultaneously, in one operation. It is a particularly attractive feature of the street lighting luminaire that the lid with the lampholder, the lamp and the connector can be fully detached electrically and mechanically and removed from the housing, so that it is possible to approach the luminaire with a spare set of the lid with the lampholder and connector fastened thereto, complete with a new lamp inserted therein. After removal of the lid from the luminaire, the spare lid assembly is placed, whereby the lamp is replaced. The lamp in the lid just removed may be replaced on the way to a next luminaire. The time necessary for the replacement of a lamp can be additionally reduced thereby.

It is favorable that the dimensions of the lid need be only a little larger, for example by 2 cm, than the greatest lateral dimension of the lamp to be placed in the luminaire.

In a favorable embodiment, the lampholder can be removed from its operational position by means of a linear translatory movement away from the housing. This has the advantage of an enhanced ease of replacement, but also of the possibility of using simple, for example commercially available male and female connectors which can be coupled and uncoupled by means of a simple linear translation.

It is furthermore favorable when a locking device for the lid is provided which can be operated without the use of tools, for example, an overlap clip at the housing which grips over the lid. This embodiment renders possible an even faster and easier lamp exchange.

In a favorable modification of the above, the lid itself carries the locking device. This embodiment offers the possibility of unlocking the unit formed by lid, lampholder, connector, and lamp with one hand, for example in one fluent movement, and removing it, and also of placing a new unit with a new lamp inside with the other hand and locking it.

In another embodiment, the opening in the housing is arranged in a hood with a hinge and a closure which is part of the housing. In a modification thereof, the hood can only be rotated about the hinge so as to be opened when the lid has been removed. This has the advantage of preventing the lamp and the lampholder from being touched while the hood is open, for example for inspection or maintenance, while they are live. In this modification, for example, the closure of the hood may be overlapped by the lid, for example, by a projecting tag of the lid.

DETAILED DESCRIPTION OF THE PREFERRED EMBODIMENTS

Figure 1:
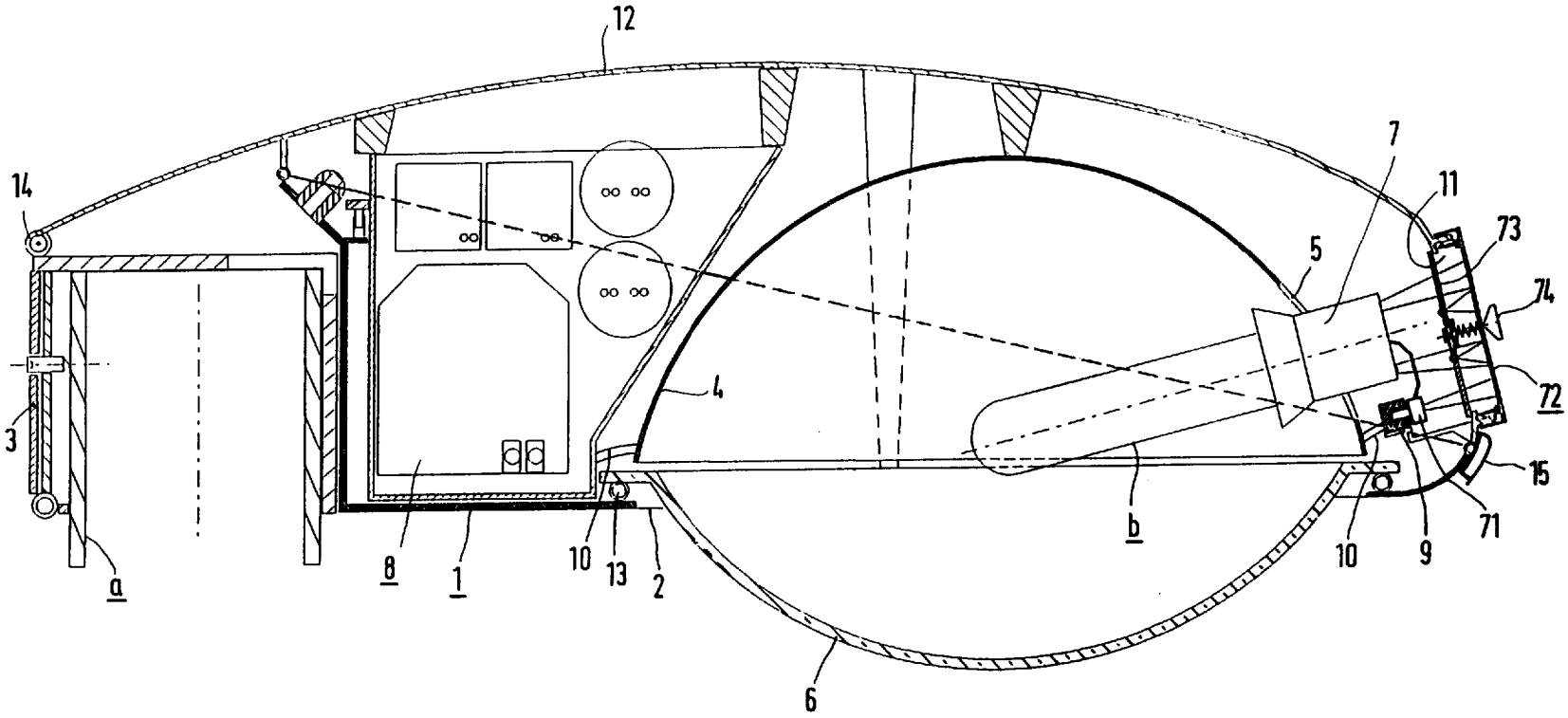
FIG. 1 is a longitudinal sectional view of a luminaire with a lamp.

In FIG. 1, the street lighting luminaire comprises a housing 1 provided with a light emission window 2 and means 3 for holding on to a mast a. A reflector 4 is present in the housing in front of the light emission window and is provided with a lampholder opening 5 at a side which faces away from the means 3 for holding on to a mast a. A transparent plate 6, for example made of polymethyl methacrylate, closes off the light emission window 2. In the Figure, the plate 6 is sealed against the housing 1 by means of a gasket 13. A lampholder 7, e.g. an Edison lampholder for holding and electrically contacting a one-sided capped electric lamp b within the reflector 4 is detachably fastened in an operational position in the lampholder opening 5. A supply unit 8 for electrically supplying an accommodated lamp b is present in the housing. The lamp shown is a high-pressure sodium discharge lamp with a tubular outer envelope. Alternatively, however, the lamp used may well have an ellipsoidal outer envelope. A male electric connector 71 is electrically and mechanically connected to the lampholder 7. A female electric connector 9 is arranged in the housing, in electric contact with the male connector 71 and electrically connected to the supply unit 8 via a cable 10. The lampholder 7 with the lamp b inside can be brought from outside the reflector 4 into its operational position in the lampholder opening 5 while bypassing the light emission window 2, and can be removed therefrom also while bypassing the light emission window 2. The male connector 71 and the female connector 9 then make electric contacts and break their electric contacts, respectively.

The housing 1 has an opening 11 through which the lampholder 7 can be brought into its operational position in the lampholder opening 5, which opening 11 in the housing 1 is closed with a lid 72 which is detachable from the housing and to which the lampholder 7 is fastened.

A hood 12, which can be opened for maintenance of the supply unit 8, of the reflector 4, and of the plate 6, forms part of the housing 1 of the luminaire shown. The hood has a hinge 14 and a closure 15. The opening 11 is present in the hood 12.

Figure 2:
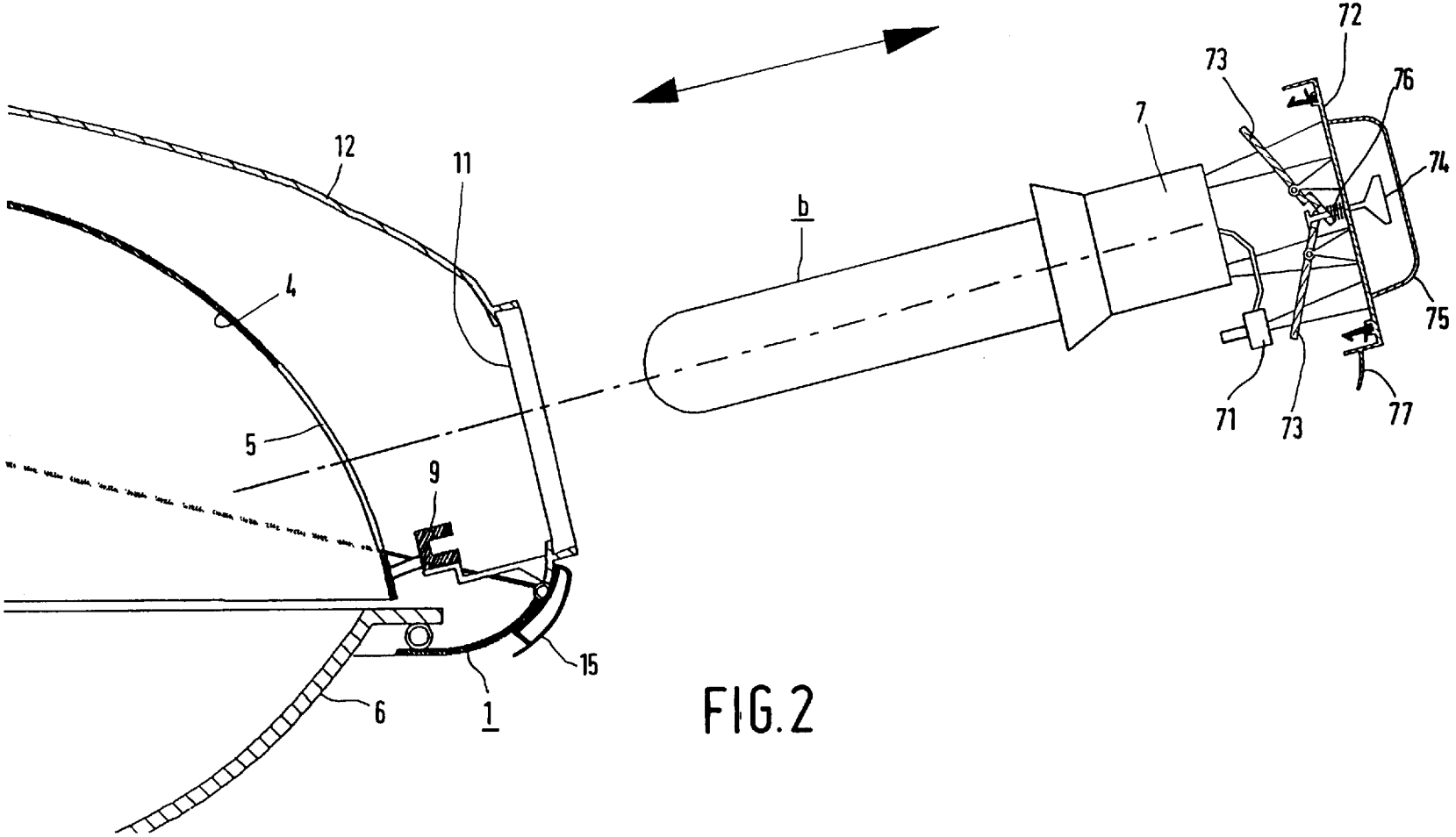
FIG. 2 shows a detail of a modified version of FIG. 1, with the lamp removed therefrom.

The lampholder 7 can be removed from its operational position by means of a linear translatory movement from the housing 1, see also FIG. 2.

The luminaire has a locking device 73 for the lid 72 of the housing 1 which can be operated without tools. The locking device 73 is supported by the lid 72. In the embodiment shown, the locking device comprises pivotable arms which are pressed against the inside of the housing 1, i.e. the inside of the hood 12 of the housing 1 in the Figures, by a spring 76.

The locking action can be lifted by pulling a button 74 at the outside of the lid 72. This is rendered even easier in the modification shown in FIG. 2, where a handle 75 is present on the lid 72 by which the unit shown can be gripped and carried. During gripping, it is possible to pull the button 74, so that the locking arms 73 pivot towards one another and their free ends assume a smaller interspacing. The lid 72 may as a result be removed in one fluent movement with one hand while the lock is being operated, complete with the lampholder 7, the lamp b, and the connector 71 from the housing, i.e. from the operational position of the lampholder 7, or may be connected to the housing in said position in such a movement.

The hood can only be opened after the lid 72 with the lamp b has been removed from the housing. A projecting tag 77 of the lid 72 overlaps the closure 15 after the lid 72 has been placed.

I claim:

1. A street lighting luminaire comprising a reflector having an opening for receiving a lampholder, a lampholder for holding and electrically contacting a one-sided capped electric lamp inside said reflector, said lampholder being detachably fastened in the lampholder opening, a housing having means for fixing said housing to a mast and a light emission window in which the reflector is fixed, said housing comprising a hood having an opening through which said lampholder can be received in the opening in the reflector, a hinge for pivoting said hood away from the reflector, and a closure for fixing said hood with respect to said reflector, a lid which closes said opening in said hood, said lampholder being fixed to said lid, a power supply accommodated in the housing, a male electrical connector fixed to said lid and electrically connected to said lampholder, a female electrical connector fixed to said housing and electrically connected to said supply unit, said male and female connectors being in electrical contact when said lid closes said opening, and a transparent plate closing the light emission window.

2. A street lighting luminaire as in claim 1 wherein said lampholder is removable from said reflector by a linear translatory movement of said lid away from said housing.

3. A street lighting luminaire as in claim 1 further comprising locking means supported by said lid for locking said lid to said housing, said locking means comprising a knob outside of said housing, said knob being pullable away from said lid to release said lid from said housing.

4. A street lighting luminaire as in claim 1 wherein said hood is pivotable about said hinge only when said lid has been removed from said hood.

5. A street lighting luminaire comprising a reflector having an opening for receiving a lampholder, a lampholder for holding and electrically contacting a one-sided capped electric lamp inside said reflector, said lampholder being detachably fastened in the lampholder opening, a housing having means for fixing said housing to a mast and a light emission window in which the reflector is fixed, said housing having an opening through which said lampholder can be received in the opening in the reflector, a lid which closes said opening in the said housing, said lampholder being fixed to said lid, locking means supported by said lid for locking said lid to said housing, said locking means comprising a knob outside of said housing, said lid being releasable from said housing in response to pulling said knob away from said lid.

6. A street lighting luminaire as in claim 5 wherein said locking means further comprises a pair of arms having distal ends which engage said housing, said distal ends being pivotable to release said lid from said housing in response to said knob being pulled.

* * * * *